US011668035B2

(12) United States Patent
Bagley

(10) Patent No.: US 11,668,035 B2
(45) **Date of Patent: *Jun. 6, 2023**

(54) QUILTING FRAME AND CLIP ASSEMBLY

(71) Applicant: Gracewood Management, Inc., West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 106 days.

This patent is subject to a terminal disclaimer.

(21) Appl. No.: 17/145,982

(22) Filed: Jan. 11, 2021

(65) Prior Publication Data

US 2021/0131000 A1 May 6, 2021

Related U.S. Application Data

(63) Continuation of application No. 16/033,218, filed on Jul. 12, 2018, now Pat. No. 10,889,930.

(51) Int. Cl.
*D05B 39/00* (2006.01)

(52) U.S. Cl.
CPC ..... *D05B 39/005* (2013.01)

(58) Field of Classification Search
CPC ..... D05B 39/005; D05B 11/00; D05C 1/02
See application file for complete search history.

(56) References Cited

U.S. PATENT DOCUMENTS 3,950,869 A 4/1976 Samarin
4,192,241 A 3/1980 Reed et al.
4,411,208 A 10/1983 Nishida et al.
4,658,522 A 4/1987 Kramer
4,834,006 A 5/1989 Goto
4,969,410 A 11/1990 Brower et al.
5,018,460 A 5/1991 Schilling et al.
5,040,473 A 8/1991 Zesch et al.
5,287,820 A 2/1994 Stutznacker
5,540,165 A 7/1996 Katou et al.
(Continued)

OTHER PUBLICATIONS

ASY Quilter, 1720 Falcon Circle So., Pocatello, Idaho. Easy Quilter Assembly Instructions, Use Instructions and Product Information—104 Pages. Date of publication—unknown to applicant. (documentation is submitted herewith.).

*Primary Examiner* — Tajash D Patel
(74) *Attorney, Agent, or Firm* — Barnes & Thornburg LLP; Ryan L. Marshall; Jessica Kiser

(57) ABSTRACT

A quilting frame assembly for machine quilting of a quilt core using a quilting machine, the quilting frame assembly having a quilting frame with a first frame element and a second frame element, a machine carriage assembly, a plurality of first element clips, and one or more second element clips, each first element clip being u-shaped, spring biased and reciprocating, and having a plurality of first clip inside frame receiver facets dimensioned and positioned to engage with two or more first frame cross-sectional corners of a first frame element member, and each second element clip being u-shaped, spring biased and reciprocating, and having a plurality of second clip inside frame receiver facets dimensioned and positioned to engage with two or more second frame cross-sectional corners of a second frame element member.

22 Claims, 6 Drawing Sheets

(56) References Cited

U.S. PATENT DOCUMENTS

| | | | | |
|---|---|---|---|---|
| 5,586,400 | A | 12/1996 | Moore | |
| 5,615,756 | A | 4/1997 | Grundei et al. | |
| 5,676,052 | A | 10/1997 | Wegrzyn et al. | |
| 5,860,375 | A | 1/1999 | Williams | |
| 5,913,275 | A | 6/1999 | Flynn | |
| 6,079,341 | A | 6/2000 | Resta | |
| 6,209,240 | B1 | 4/2001 | Engle | |
| 6,631,688 | B1 | 10/2003 | Maag | |
| 6,792,884 | B1 | 9/2004 | Barrus | |
| 6,860,211 | B2 | 3/2005 | Valeriote et al. | |
| 6,883,446 | B2 | 4/2005 | Koerner | |
| 7,011,031 | B1 | 3/2006 | Bradley | |
| 7,207,281 | B1 | 4/2007 | Kasa | |
| 7,222,445 | B2 | 5/2007 | Schmidt | |
| 7,584,709 | B2 | 9/2009 | Nakatsu et al. | |
| 7,990,914 | B2 | 8/2011 | Kang et al. | |
| 9,145,630 | B2 | 9/2015 | McCoy et al. | |
| 10,889,930 | B2 * | 1/2021 | Bagley | D05B 39/005 |
| 2003/0200906 | A1 | 10/2003 | Maag | |
| 2012/0318181 | A1 | 12/2012 | Kasa | |

* cited by examiner

QUILTING FRAME AND CLIP ASSEMBLY

CROSS-REFERENCE TO RELATED APPLICATIONS

This application is a continuation of U.S. application Ser. No. 16/033,218, filed Jul. 12, 2018, the contents of which are hereby incorporated herein by reference in their entirety.

BACKGROUND

The present invention is in the field of devices and methods for machine quilting, and, in particular, in the field of quilting frames and other devices and methods for the positioning and retention of fabric for sewing with a quilting machine.

Devices for machine quilting typically consist of three primary components, a frame, a sewing machine, and a machine carriage having a carriage bottom plate that travels laterally on an x-axis and a carriage top plate that travels longitudinally on a y-axis. Quilt fabric layers, which typically consist of backing fabric, batting, and top fabric, but may consist of as few as one layer of fabric or more than three layers, which single fabric layer, or multiple layers collectively, may be referred to in this application as a Aquilt core@. The term Afabric layers,@ when used in this application, shall be defined to include a single layer of fabric. For a typical quilting frame, the fabric layers are rolled onto fabric layer rails and fed from the respective fabric layer rails to a take-up rail that passes through the throat of the sewing machine, suspending the fabric layers of the quilt core together to rest on the sewing machine bed. For a typical quilting frame, in order for the fabric layers of the quilt core to remain flat and straight, it is necessary for the fabric layer rails and the take-up rail to be longer than the quilt is wide.

For a typical quilting frame, the sewing machine is positioned on and secured to the quilting frame carriage top plate and is guided on the machine carriage to create a desired stitching pattern as the layers of fabric are quilted together. The sewing machine, and particularly the needle bar of the sewing machine, is guided longitudinally and laterally across the available quilting work area, which is determined by the length of the throat of the sewing machine and the width of the quilt fabric itself, the width of the quilt being limited to the width of the quilting frame. When the fabric in the work area has been sewn, the fabric is rolled forward from the fabric layer rails to the take-up rail so that the completed area is rolled onto the take-up rail which passes through the throat of the sewing machine. This also advances the fabric that has not yet been quilted into the work area and the new strip of un-quilted fabric area may then be sewn. A typical quilting frame requires that the quilt be sewed from front to back, or vice versa, with the fabric progressively being fed onto the take-up rail as each strip of the quilt core is sewn from one side of the quilt core to the other.

An alternative to machine quilting with a traditional frame is to quilt by hand, performing all the stitching without a sewing machine, simply using a needle and thread. Another alternative is to baste the three layers of fabric together using pins or small stitches later to be removed. Once the fabric is basted, the user can quilt the layers together by guiding the fabric through the machine by hand. Hoops may also used to hold small areas of the quilt flat and straight to perform the stitching. Embroidery machines, for example, use a hoop to hold the fabric and then through motor control, move the hoop while the sewing machine stitches to create the desired patterns on the fabric.

Quilting without a frame requires basting, which is time consuming. Hand quilting or quilting by using a hoop also requires basting, and moving the fabric to create the sewing patterns can be cumbersome due to the amount of fabric that has to be manipulated in a large quilt. Machine quilting on a frame is a much more convenient and expeditious way to complete a quilt. However, machine quilting on a typical frame requires a large frame in order to make large quilts. Many quilters do not have enough space to accommodate the large quilting frame.

An objective of the present invention is to provide an apparatus for use in machine quilting that does not incorporate a full width quilting frame.

A further objective of the present invention is to provide an apparatus for use in machine quilting that requires substantially less space than that required by a typical quilting frame.

A further objective of the present invention is to provide an apparatus for use in machine quilting that does not require basting of the fabric layers of the quilt core.

A further objective of the present invention is to provide a fabric retention and positioning apparatus for use in machine quilting that incorporates a quilting frame to hold the quilt core on all four sides of the work area to be quilted, rather than full width fabric layer rails and a full width take-up rail that passes through the throat of the sewing machine.

A further objective of the present invention is to provide an apparatus for machine quilting which incorporates a quilting frame which allows the fabric to drape around the frame instead of rolling from fabric rails onto a take-up rail.

A further objective of the present invention is to provide an apparatus for machine quilting which incorporates a quilting frame that provides for the segmented stitching of a larger size quilt while requiring a much smaller space occupied by the quilting apparatus.

A further objective of the present invention is to provide an apparatus for machine quilting which incorporates a quilting frame for which frame width is no longer a limiting factor in the size of a quilt that can be quilted.

A further objective of the present invention is to provide an apparatus for machine quilting which incorporates a quilting frame and a machine carriage.

SUMMARY OF THE INVENTION

The quilting frame assembly of the present invention may be comprised of a frame support structure, a quilting frame comprising a first frame element and a second frame element, first element clips, second element clips, and a machine carriage assembly. The frame support structure supports, stabilizes and positions the quilting frame, and provides workable access to the quilting frame.

The quilting frame may be comprised of a first frame element and a second frame element. The first frame element may be affixed to the frame support structure and may be comprised of three first frame element members, a front frame member, a first side frame member, and a second side frame member. Each first frame element member may have a rectangular or approximately rectangular first frame member cross-section with a first frame member cross-sectional top corner oriented generally upwardly as a first frame member apex. The term “rectangular,” when used in this specification, including the claims, in reference to a first frame element member, shall be defined to include a first frame element member which has a rectangular or approximately rectangular cross-section, and to include a square or approximately square cross-section. The term "oriented upwardly," when used in this specification, including the claims, in reference to a first frame member cross-sectional top corner or the first frame element apex, shall be defined to include a first frame member cross-sectional top corner or first frame element apex which is oriented upwardly or generally upwardly.

A preferred embodiment of the second frame element may comprise a rear frame member having a rectangular or approximately rectangular second frame member cross-section with a second frame member cross-sectional bottom corner oriented generally downwardly as a second frame member base. The term "rectangular," when used in this specification, including the claims, in reference to a rear frame member, shall be defined to include a rear frame member which has a rectangular or approximately rectangular cross-section, and to include a square or approximately square cross-section. The term "oriented downwardly," when used in this specification, including the claims, in reference to a second frame member cross-sectional bottom corner or a second frame member base, shall be defined to include second frame member cross-sectional bottom corner or the second frame member base which is oriented downwardly or generally downwardly.

Other embodiments of the first frame element members or the rear frame member of the second frame element may have a geometric cross-section with a geometric shape which may include a diamond, a parallelogram, a pentagon, a heptagon, or an octagon. Where the term "geometric" is used in this specification, including the claims, in regard to a first frame member cross-section or a rear frame member cross-section, it shall be defined to mean a cross-section having a geometric shape with three or more first frame cross-sectional corners. A first frame element member or rear frame member having a rectangular, including particularly a square shaped, or a diamond shaped or parallelogram shaped cross-section, are preferred by the present inventor due to the ease of manufacturing and the ease and stability of the facet engagement of the first clip inside frame receiver facets with two or more first frame cross-sectional corners of a first frame element member and the ease and stability of the facet engagement of the second clip inside frame receiver facets with two or more second frame cross-sectional corners of the rear frame member with a quilt core draped over the first frame element members and the rear frame member. These embodiments of the first frame element member and the rear frame member cross-sections readily provide for a preferred orientation of the first frame member cross-section with a first frame member apex oriented upwardly and for a preferred orientation of the rear frame member with the rear frame member cross-sectional bottom corner oriented downwardly.

When a quilt core is positioned and secured by a front frame member of the first frame element and the rear frame member, each first frame member apex of each first frame element member and the second frame member base of the rear frame member may be positioned in or approximately positioned in and bordering a frame fabric plane, which may preferably be horizontal or approximately horizontal for normal setup and operation of the quilting frame assembly.

A preferred embodiment of the quilting frame assembly of the present invention shown may have one or more first element clips for each first frame element member. Each first element clip may have a generally u-shaped or horseshoe shaped cross-section. The term "u-shaped" when used in reference to a first element clip in this specification, including the claims, shall be defined to include any first element clip shape having a u-shaped, generally u-shaped, or horseshoe shaped cross-section, and to include a first element clip shape having a cross-section in which the first element clip cross-section has a first element clip receiving width which is greater than the first element clip throat width of the first element clip throat. The first element clips may be spring biased and reciprocating, and may have a plurality of first clip inside frame receiver facets in the first clip inside surface which are dimensioned and positioned to engage with two or more first frame cross-sectional corners of a first frame element member with a quilt core draped over the first frame element member.

The quilting frame assembly may incorporate one or more second element clips. Each second element clip may be generally u-shaped. The term "u-shaped" when used in reference to a second element clip in this specification, including the claims, shall be defined to include any second element clip shape having a u-shaped, generally u-shaped, or horseshoe shaped cross-section, and to include a second element clip shape in which the second element clip cross-section has a second element clip receiving width which is greater than the second element clip throat width of the second element clip throat. The second element clip may be spring biased and reciprocating and may have a plurality of second clip inside frame receiver facets dimensioned and positioned to engage with two or more second frame cross-sectional corners of the rear frame member with the quilt core draped over the rear frame member.

A preferred embodiment of the rear frame member of the second frame element may incorporate one or more second element roll straps which may each be secured to the rear frame element by a second element roll strap anchor. A preferred embodiment of the second element roll strap may also incorporate a second element roll strap connector, which may incorporate a second element roll strap hook which may be attached to the second element roll strap by a hook strap connector. The hook strap connector may also provide for a length adjustment for the working strap section of the second element roll strap which may be used to secure a quilt core roll of previously sewn fabric zones of the quilt core in the machine throat of a quilting machine. This may provide for subsequent fabric zones to be positioned and secured for sewing, while the unsewn or previously sewn fabric zones may be rolled onto a flexible take-up spool and prevented from interfering with the sewing of the selected fabric zone. A preferred embodiment of the second element clips may incorporate a second element clip roll strap receiver to which a roll strap hook may be engaged to secure the quilt core roll of previously sewn fabric zones.

The quilting frame assembly may incorporate one or more frame support connectors for connecting the quilting frame to the frame support structure. The quilting frame assembly may also incorporate a frame horizontal adjustment assembly wherein the first side frame member and the second side frame member may be slideably connected to frame support structure, providing for a quilting frame width adjustment by a user. The quilting frame assembly may also incorporate a frame support vertical adjustment assembly and a quilting frame vertical adjustment assembly which may provide for a machine carriage assembly height adjustment and a quilting frame height adjustment by the user.

The quilting frame assembly further may further comprise a machine carriage assembly which is supported by a front carriage track and a rear carriage track which are affixed on opposing ends to the frame support structure. Front carriage rollers and rear carriage rollers provide for carriage lateral movement, and thus for the machine lateral movement of a quilting machine. A pair of longitudinal tracks on the carriage lateral element may provide for the quilting machine with an integral wheeled base or a separate wheeled machine base to which the quilting machine may be removably mounted. Whether the quilting machine itself or the quilting machine mounted on a separate wheeled machine base is positioned on the longitudinal tracks, the quilting machine is free rolling upon the carriage lateral element, thereby providing for machine longitudinal movement concurrently with the carriage lateral movement provided by the carriage lateral element. The machine carriage assembly, therefore, provides for machine lateral movement and machine longitudinal movement.

A quilt core may be secured to the first frame element and the second frame element by draping the quilt core over the front frame member, the first side frame member, and the second side frame member of the first frame element, and over the rear frame member of the second frame element, and securing the quilt core in place by the first element clips and the second element clips. This may position a fabric zone of the quilt core for sewing. Successive fabric zones of the quilt core may be consecutively secured to the quilting frame of the quilting frame assembly with the sewn fabric zones of the quilt core advanced into the machine throat and rolled onto a flexible take-up spool to help keep the fabric layers of the sewn fabric zones from interfering with the sewing of the fabric zone positioned on the quilting frame for sewing.

DETAILED DESCRIPTION

Figure 1:
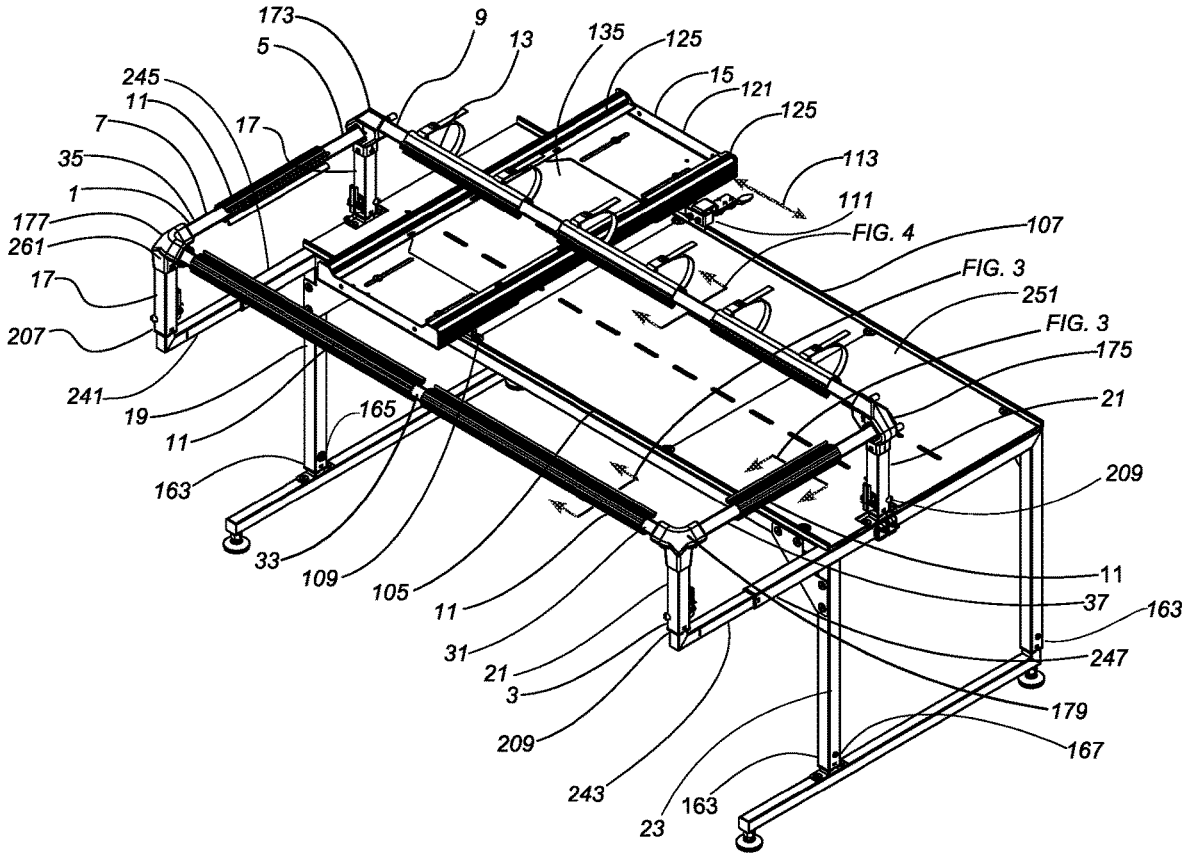
FIG. 1 is a front perspective view of a preferred embodiment of a quilting frame assembly of the present invention, including preferred embodiments of a frame support structure, a quilting frame, a machine carriage assembly, first element clips and second element clips of the present invention.

Referring first to FIG. 1, a front perspective view of a preferred embodiment of a quilting frame assembly 1 of the present invention is shown. For the embodiment shown, the quilting frame assembly 1 is comprised of a frame support structure 3, a quilting frame 5 comprising a first frame element 7 and a second frame element 9, first element clips 11, second element clips 13, and a machine carriage assembly 15. For the embodiment shown the frame support structure 3 is comprised of a first end support 17 which connects to a first frame end 19 and a second end support 21 which connects to a second frame end 23. Other variations and designs for the frame support structure 3 for supporting, stabilizing and positioning the quilting frame 5, and providing workable access to the quilting frame 5, will be known to persons ordinarily skilled in the art, in view of the disclosures of the specification and drawings presented. Various materials known to persons skilled in the art may be used for the frame support structure 3, as well as the other components of the quilting frame assembly 1 and quilting frame 5 of the present invention, which will provide the desired structural strength, durability, functionality, economy and appearance.

Figure 3:
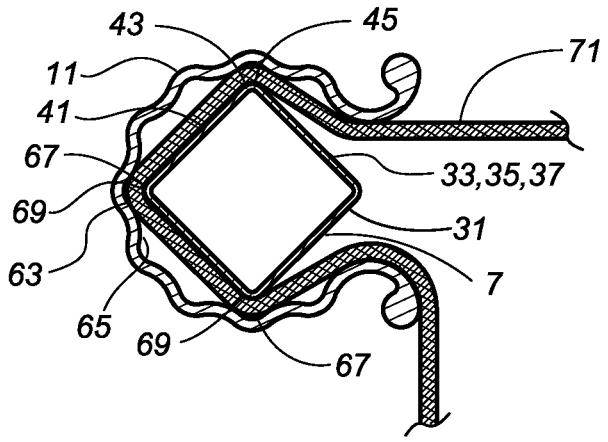
FIG. 3 is cross-section detail of a preferred embodiment of a first element clip engaged with a first frame element member of the first frame element of the present invention, with a quilt core secured to the first frame element member by the first element clip.

The quilting frame 5, for the embodiment shown, is comprised of a first frame element 7 and a second frame element 9. For the embodiment of the quilting frame 5 shown in FIG. 1, the first frame element 7 is affixed to the frame support structure 3 and may be comprised of three first frame element members 31, a front frame member 33, a first side frame member 35, and a second side frame member 37. Referring also to FIG. 3, each first frame element member 31 of the first frame element 7 may have a rectangular or approximately rectangular first frame member cross-section 41 with a first frame member cross-sectional top corner 43 oriented generally upwardly as a first frame member apex 45. The term "rectangular," when used in this specification, including the claims, in reference to a first frame element member 31, shall be defined to include a first frame element member 31 which has a rectangular or approximately rectangular cross-section as illustrated in FIG. 3. The term "oriented upwardly," when used in this specification, including the claims, in reference to a first frame member cross-sectional top corner 43 or the first frame element apex 45, shall be defined to include a first frame member cross-sectional top corner 43 or first frame element apex 45 which is oriented upwardly or generally upwardly.

Figure 4:
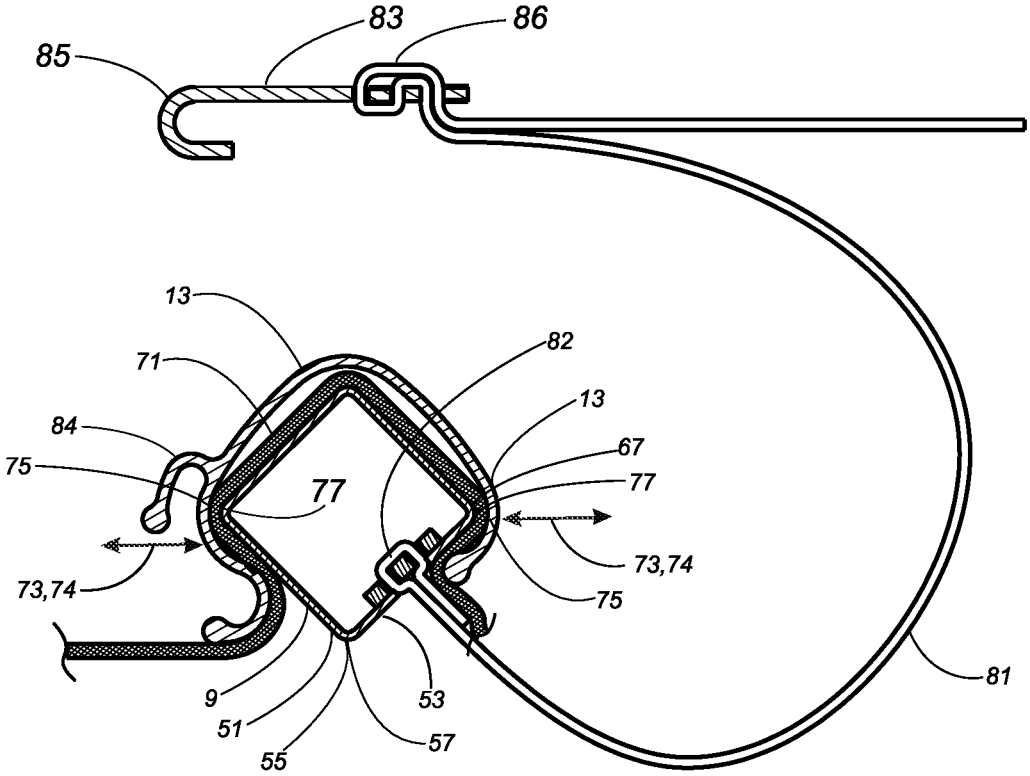
FIG. 4 is cross-section detail of a preferred embodiment of a second element clip engaged with a rear frame member of the second frame element of the present invention, with a quilt core secured to the rear frame member by the second element clip.

Referring also to FIG. 4, the second frame element 9 may comprise a rear frame member 51 having a rectangular or approximately rectangular second frame member cross-section 53 with a second frame member cross-sectional bottom corner 55 oriented generally downwardly as a second frame member base 57. The term "rectangular," when used in this specification, including the claims, in reference to a rear frame member 51, shall be defined to include a rear frame member 51 which has a rectangular or approximately rectangular cross-section as illustrated in FIG. 4. The term "oriented downwardly," when used in this specification, including the claims, in reference to a second frame member cross-sectional bottom corner 55 or the second frame member base 57, shall be defined to include second frame member cross-sectional bottom corner 55 or the second frame member base 57 which is oriented downwardly or generally downwardly.

Figure 5:
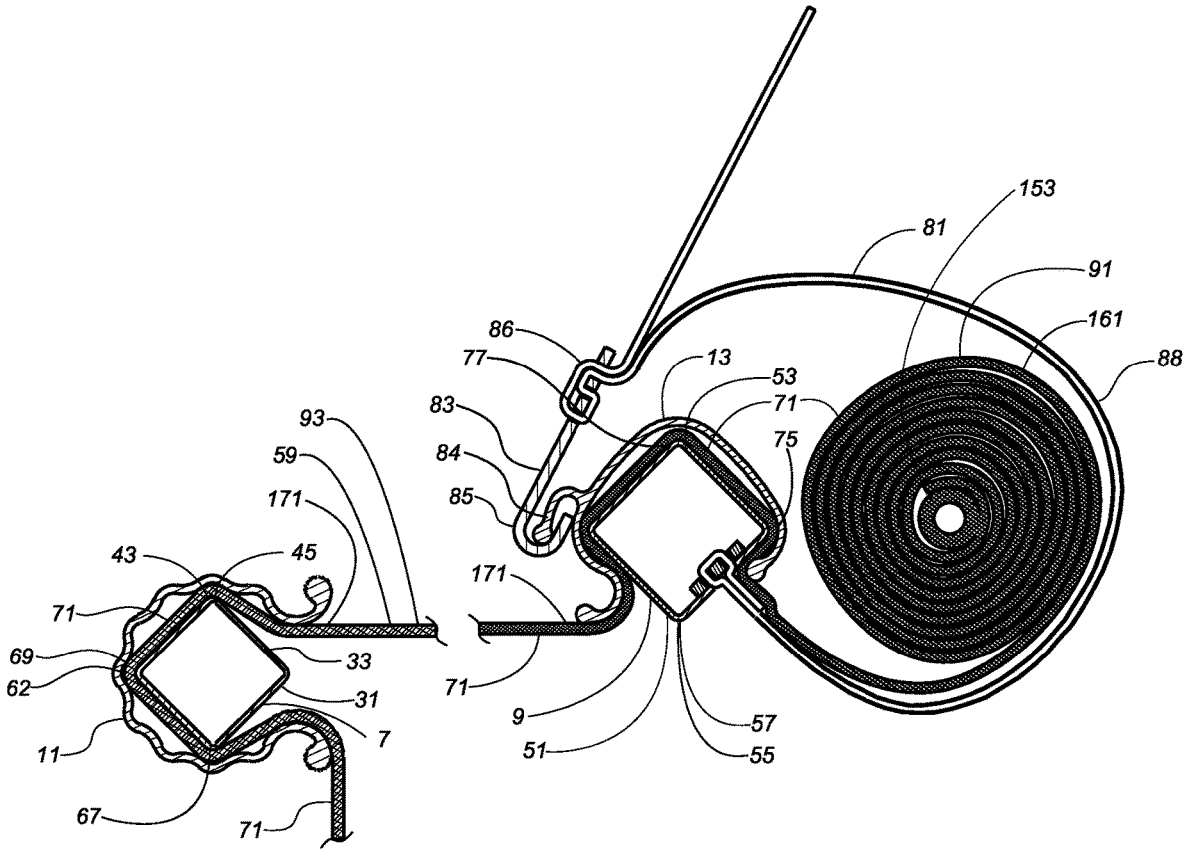
FIG. 5 is a cross-section detail of a preferred embodiment of the quilting frame of the present invention, showing a first element clip engaged with a front frame member of the first frame element and a second element clip engaged with a rear frame member of the second frame element of the present invention, with a quilt core secured to the quilting frame by the first element clip and the second element clip, and a quilt core roll of sewn quilt core secured to the second element clip and the rear frame member by a second element roll strap.

Referring also to FIG. 5, which is a cross-section illustrating a quilt core 71 positioned and secured by a front frame member 33 of the first and the rear frame member 51, for the preferred embodiment of the quilting frame assembly 1 and the quilting frame 5 shown, each first frame member apex 45 of each first frame element member 31 and the second frame member base 57 of the rear frame member 51 may be positioned in or approximately positioned in and bordering a frame fabric plane 59, which, for the embodiment of the quilting frame 5 shown, may preferably be horizontal or approximately horizontal for normal setup and operation of the quilting frame assembly 1.

Referring again to FIG. 1, FIG. 3 and FIG. 7, the preferred embodiment of the quilting frame assembly 1 of the present invention shown may have one or more first element clips 11 for each first frame element member 31. For the embodiment shown, each first element clip 11 may have a generally u-shaped or horseshoe shaped cross-section as shown in FIG. 3. The term "u-shaped" when used in reference to a first element clip 11 in this specification, including the claims, shall be defined to include any first element clip shape having a u-shaped, generally u-shaped, or horseshoe shaped cross-section, and to include a first element clip shape having a cross-section in which the first element clip cross-section has a first element clip receiving width 221 which is greater than the first element clip throat width 223 of the first element clip throat 181 as shown in FIG. 7. The first element clip 11 may have a first element clip spring bias 61 and provide for first element reciprocation 62 as shown in FIG. 7, and may have a plurality of first clip inside frame receiver facets 63 in the first clip inside surface 65 which are dimensioned and positioned for facet engagement 67 with two or more first frame cross-sectional corners 69 of a first frame element member 31 with a quilt core 71 draped over the first frame element member 31 as shown in FIGS. 3, 5, 6 and 7. Other shapes and cross-sections for the first element clips 11 may be utilized which will provide for facet engagement 67 of the first clip inside frame receiver facets 63 with two or more first frame cross-sectional corners 69 of a first frame element member 31 with a quilt core 71 draped over the first frame element member 31 as shown in FIGS. 3, 5, 6 and 7.

Figure 8:
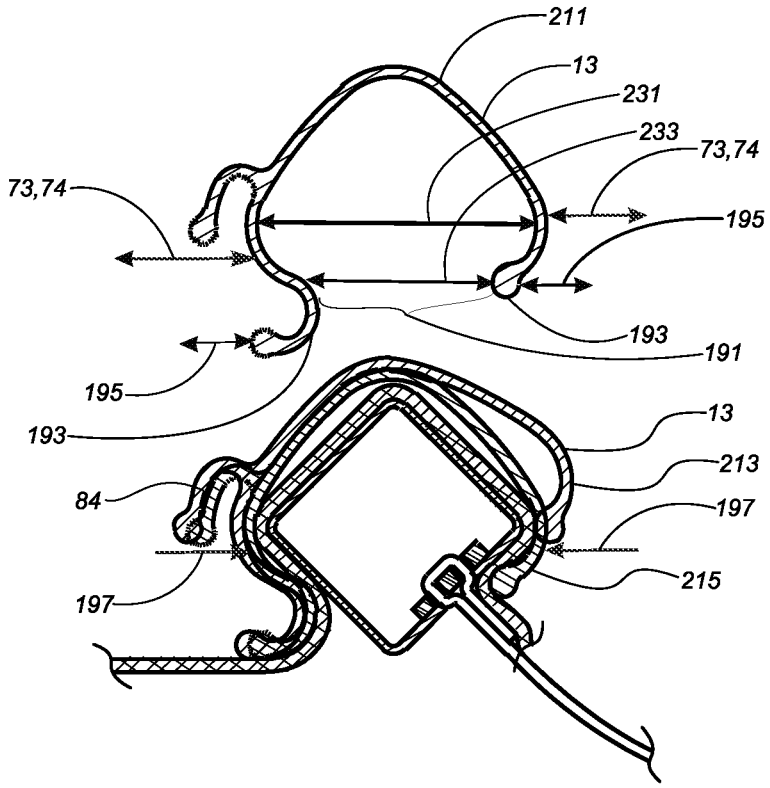
FIG. 8 is cross-section detail illustrating the insertion of a second element clip on and engagement with a rear frame member of a second frame element with a quilt core draped over the rear frame member and secured to the rear frame member by the second element clip.

Referring again to FIG. 4, FIG. 5 and also to FIG. 8, the embodiment of the quilting frame assembly 1 shown may incorporate one or more second element clips 13. For the embodiment shown, each second element clip 13 may be generally u-shaped as shown in FIG. 4 and FIG. 5. The term "u-shaped" when used in reference to a second element clip 13 in this specification, including the claims, shall be defined to include any second element clip shape having a u-shaped, generally u-shaped, or horseshoe shaped cross-section, and to include a second element clip shape in which the second element clip cross-section has a second element clip receiving width 231 which is greater than the second element clip throat width 233 of the second element clip throat 191. The second element clip 13 may have a second element clip spring bias 73 and provide for second element clip reciprocation 74, and may have a plurality of second clip inside frame receiver facets 75 dimensioned and positioned to engage with two or more second frame cross-sectional corners 77 of the rear frame member 51 with the quilt core 71 draped over the rear frame member 51 as shown in FIG. 4 and FIG. 5. Other shapes and cross-sections for the second element clips 13 may be utilized which will provide for the second clip inside frame receiver facets 75 to engage with two or more second frame cross-sectional corners 77 of the rear frame member 51 of the second frame element 9 with a quilt core 71 draped over the rear frame member 51 of the second frame element 9 as shown in FIGS. 4 and 5.

Figure 2:
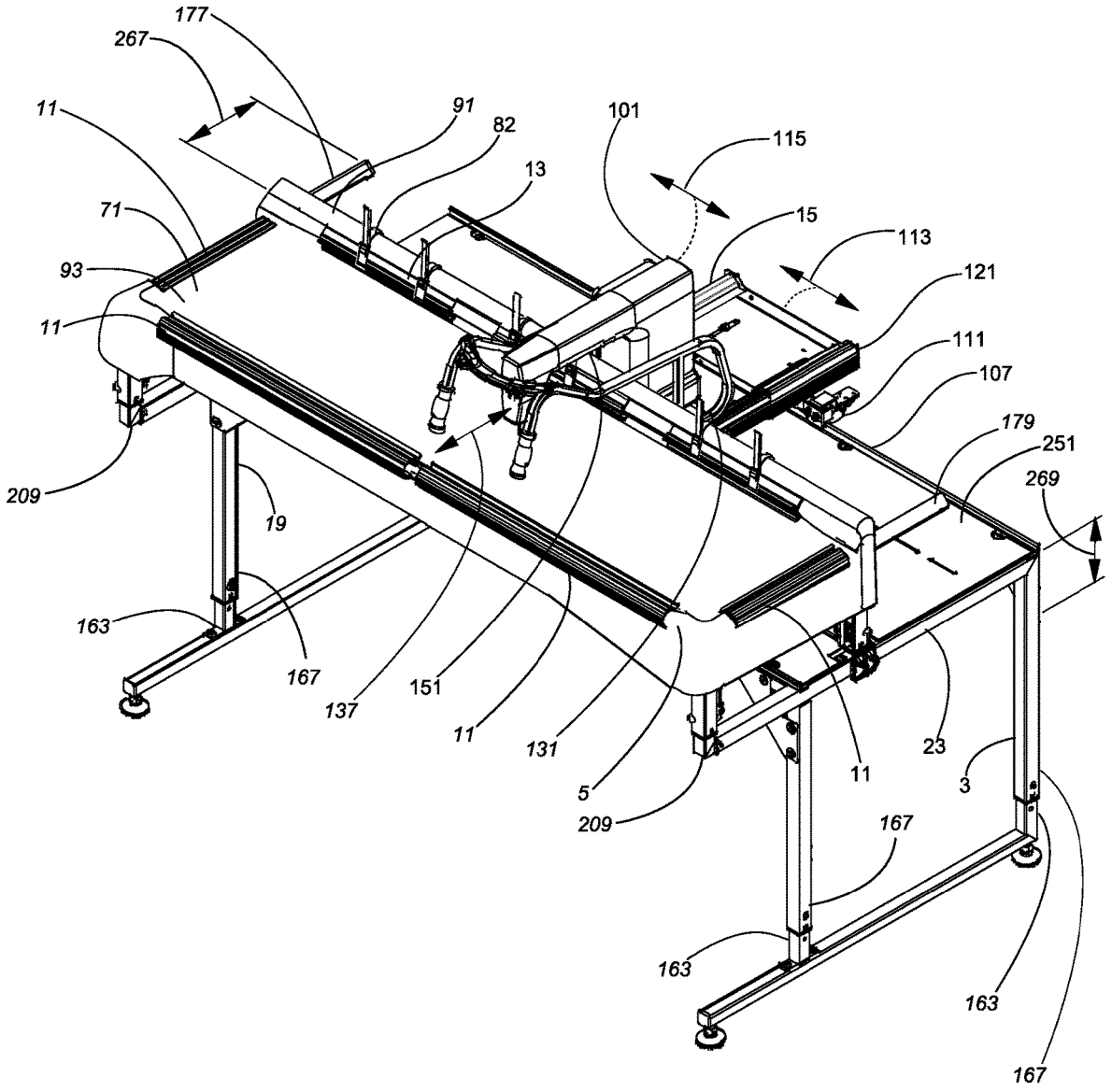
FIG. 2 is a front perspective view of the preferred embodiment of the quilting frame assembly of FIG. 1 with a quilt core positioned and secured on the quilting frame.

Referring further to FIG. 4 and FIG. 5, a preferred embodiment of the rear frame member 51 of the second frame element 9 may incorporate one or more second element roll straps 81 which may each be secured to the rear frame element 9 by a second element roll strap anchor 82. In view of the disclosures of this specification and the drawings, various devices for the second element roll strap anchor 82 for attaching the second element roll straps 81 to the rear frame member 51 will be known to persons of skill in the art. A preferred embodiment of the second element roll strap 81 may also incorporate a second element roll strap connector 83, which may incorporate a second element roll strap hook 85 which may be attached to the second element roll strap 81 by a hook strap connector 86 as shown in FIG. 4 and FIG. 5. The hook strap connector 86 may also provide for a length adjustment for the working strap section 88 of the second element roll strap 81 which may be used to secure a quilt core roll 91 of previously sewn fabric zones 161 of the quilt core 71 in the machine throat 151 of a quilting machine 101. This may provide for subsequent fabric zones 93 to be positioned and secured, as shown in FIG. 2 and FIG. 5, for sewing, while the unsewn or previously sewn fabric zones 161 may be rolled onto a flexible take-up spool 153 and prevented from interfering with the sewing of the selected fabric zone 93. A preferred embodiment of the second element clips 13 may incorporate a second element clip roll strap receiver 84 to which a second element roll strap hook 85 may be engaged to secure the quilt core roll 91 of previously sewn fabric zones 161 as shown in FIG. 5. Other embodiments of the second element roll strap connector 83 and the second element clip roll strap receiver 84 providing for engaging the second element roll straps 81 with the second element clips 13 will be known to persons of skill in the art in view of the disclosures of this specification and the drawings.

Referring again to FIG. 1 and FIG. 2, the quilting frame assembly 1 may incorporate one or more frame support connectors 261 for connecting the quilting frame 5 to the frame support structure 3. For the embodiment of the quilting frame 5 and the frame support structure 3 shown in FIG. 1 and FIG. 2, four frame support connectors 261, a first front frame support connector 177, a second front frame support connector 179, a first rear frame support connector 173, and a second rear frame support connector 175. For the embodiment of the quilting frame 5 and the frame support structure 3 shown, the first side frame member 35 may be slideably connected to first rear frame support connector 173, the second side frame member 37 may be slideably connected to second rear frame support connector 175, the first horizontal frame support member 241 may have a first frame horizontal adjustment assembly 245, and the second horizontal frame support member 243 may have a second frame horizontal adjustment assembly 247. The first rear frame support connector 173, the second rear frame support connector 175, the first frame horizontal adjustment assembly 245, and the second frame horizontal adjustment assembly 247 may provide for a quilting frame width adjustment 267 as shown in FIG. 2. Other embodiments of the first rear frame support connector 173, the second rear frame support connector 175, the first frame horizontal adjustment assembly 245, and the second frame horizontal adjustment assembly 247 will be obvious to persons of skill in the art, in view of the disclosures of this specification and the drawings. Further, other embodiments of the frame support structure 3 or the connection of the quilting frame 5 to the frame support structure 3, other than that shown in FIG. 1 and FIG. 2, which provide for a quilting frame width adjustment 267 will be obvious to persons of skill in the art, in view of the disclosures of this specification and the drawings.

Referring again to FIG. 1 and FIG. 2, the quilting frame assembly 1 may incorporate a frame support vertical adjustment assembly 167 on each frame support structure leg 163 which may provide for a machine carriage assembly and quilting frame height adjustment 269 by the user as shown in FIG. 2. The quilting frame assembly 1 may also incorporate a quilting frame vertical adjustment assembly 209 on each quilting frame vertical support member 207 which may provide for a quilting frame height adjustment by the user to accommodate dimension variations for the quilting machines 101 used. Further, other embodiments of the frame support structure 3, the frame support vertical adjustment assembly 167, or the quilting frame vertical adjustment assembly 209 other than that shown in FIG. 1 and FIG. 2, which provide for a machine carriage assembly and quilting frame height adjustment 269 or for quilting frame height adjustment will be obvious to persons of skill in the art, in view of the disclosures of this specification and the drawings. A display plate 251 may be incorporated in the frame support structure 3 to facilitate the user displaying patterns in a position that is convenient and helpful to the quilting process for the user.

Referring again to FIG. 1 and also to FIG. 2, the quilting frame assembly 1 of the present invention further comprises a machine carriage assembly 15 which is supported by a front carriage track 105 and a rear carriage track 107 which are affixed on opposing ends to the first frame end 19 and the second frame end 23. For the embodiment shown, front carriage rollers 109 and rear carriage rollers 111 provide for carriage lateral movement 113, and thus for the machine lateral movement 115 of a quilting machine 101 as shown in FIG. 2. The embodiment of the machine carriage assembly 15 shown in FIG. 1 and FIG. 2 incorporates a carriage lateral element 121 to which the carriage rollers 109,111 are affixed, which provide for the machine carriage assembly 15 to accomplish carriage lateral movement 113, and a pair of longitudinal tracks 125, which for the embodiment shown in FIG. 1 and FIG. 2, provide for a quilting machine 101 with an integral wheeled base 131, as shown in FIG. 2 or a separate wheeled machine base 135, as shown in FIG. 1, to which a quilting machine 101 may be removably mounted, to provide for machine longitudinal movement 137 on the longitudinal tracks 125 on the carriage lateral element 121. Whether the quilting machine 101 itself or the quilting machine 101 mounted on a separate wheeled machine base, is positioned on the longitudinal tracks 125, the quilting machine 101 is free rolling upon the carriage lateral element 121 thereby providing for machine longitudinal movement 137 concurrently with the carriage lateral movement 113 provided by the carriage lateral element 121. The machine carriage assembly 15, therefore, provides for machine lateral movement 115 and machine longitudinal movement 137 as shown in FIG. 2 for a quilting machine 101 mounted on the machine carriage assembly 15.

Figure 6:
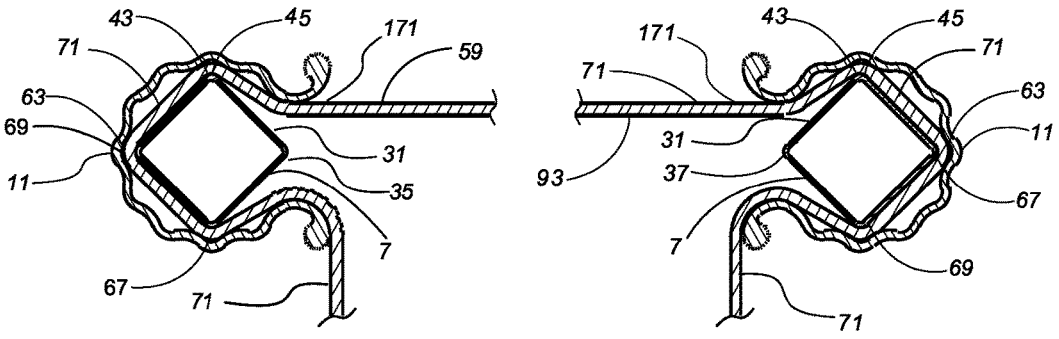
FIG. 6 is a cross-section detail of a preferred embodiment of the quilting frame of the present invention, showing a first element clip engaged with a first side frame member of the first frame element and a first element clip engaged with a second side frame member of the present invention, with a quilt core secured to the quilting frame by the first element clips.
Figure 7:
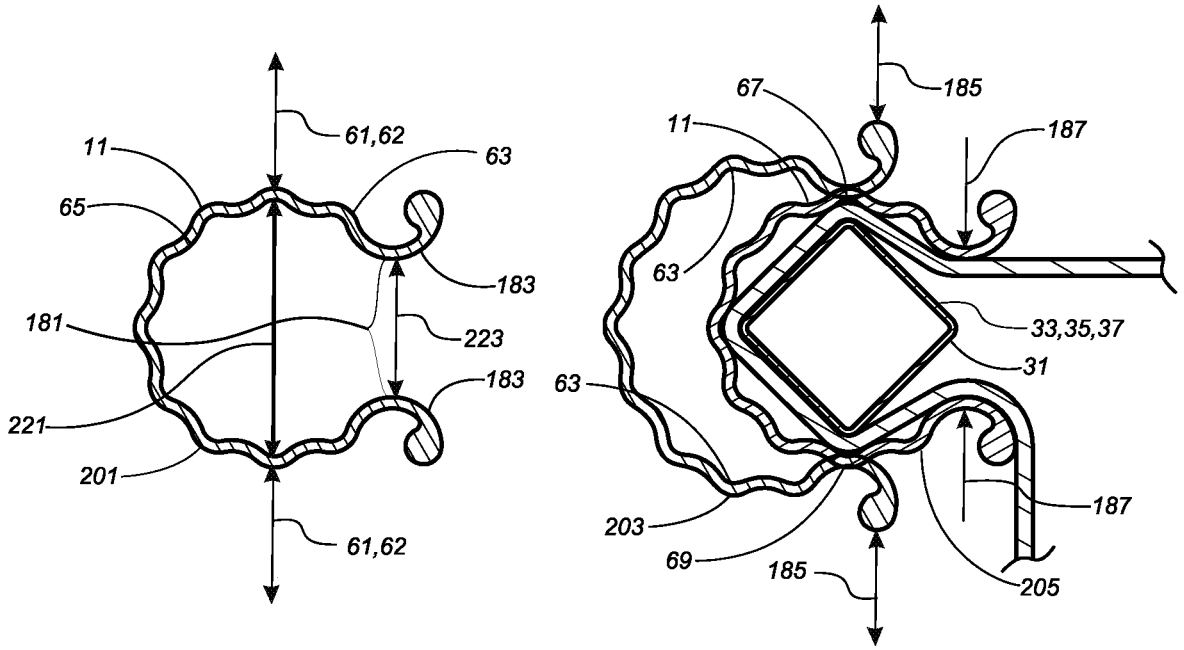
FIG. 7 is cross-section detail illustrating the insertion of a first element clip on and engagement with a first frame element member with a quilt core draped over the first frame element and secured to the first frame element member by the first element clip.

Referring now to FIG. 2, FIG. 5 and FIG. 6, a quilt core 71 may be secured to the first frame element 7 and the second frame element 9 by draping the quilt core 71 over the front frame member 33, the first side frame member 35, and the second side frame member 37 of the first frame element 7, and over the rear frame member 51 of the second frame element 9, and securing the quilt core 71 in place by the first element clips 11 and the second element clips 13. This may position a fabric zone 93 of the quilt core 71 for sewing. Successive fabric zones 93 of the quilt core 71 may be consecutively secured to the quilting frame 5 of the quilting frame assembly 1 with the previously sewn fabric zones 161 of the quilt core 71 advanced into the machine throat 151 and rolled onto a flexible take-up spool 153, as shown in FIG. 5, to help keep the fabric layers of the previously sewn fabric zones 161 from interfering with the sewing of the fabric zone 93 positioned on the quilting frame 5 for sewing.

When the quilt core 71 is secured and the selected fabric zone 93 is in place as shown in FIGS. 2,5,6 the quilting machine 101 may be operated by the user to sew the desired quilting pattern in the fabric zone 93. Once the sewing of the fabric zone 93 is completed, the first element clips 11 may be removed from each of the first frame element members 31 and the now sewn fabric zone 93, of the quilt core 71, and the second element clips 13 may be removed from the rear frame member 51 of the second frame element 9 and the now sewn fabric zone 93 of the quilt core 71. The quilt core 71 may then be moved, draped over the first frame element 7 and the second frame element 9 in a new position, and then re-secured, one or more respective first element clips 11 being engaged with each of the first frame element members 31, the front frame member 33, the first side frame member 35, and the second side frame member 37, and with the new selected fabric zone 93 of the quilt core 71 having a new selected fabric zone perimeter 171, and one or more of the second element clips 13 being engaged with the rear frame member 51 of the second frame element 9, and with the new selected fabric zone 93 of the quilt core 71 having the new selected fabric zone perimeter 171 proximal to the second element clip also, the selected new fabric zone 93 being positioned and secured for sewing by the user.

The quilting frame assembly 1 and the quilting frame 5 of the present invention provide for complete flexibility in the sequencing of the sewing of the respective fabric zones 93. A typical quilting frame requires that the quilt be sewed from front to back, or vice versa, with the fabric progressively being fed onto a take-up rail as each strip of a quilt core is sewed from one side of the quilt core to the other. The quilting frame assembly 1 and the quilting frame 5 of the present invention, on the other hand, provide for the quilt core 93 to be re-positioned laterally, longitudinally or diagonally, or to be rotated to any extent desired by the user. When sewing is completed on a fabric zone 93, the user has complete flexibility to re-position the quilt core as desired for the convenience or preference of the user as the user progresses from one fabric zone 93 to another. The user can sequence the sewing of the fabric zones as desired and can overlap respective fabric zones 93 on any side, in any direction, and to any extent desired.

Referring also FIG. 7, for the preferred embodiment of the first element clip 11 shown, the first element clip 11 may be constructed of a material, such as steel or other strong, flexible metal or plastic, that provides for the first element clip spring bias 61 and first element clip reciprocation 62. The first element clip 11 may have a first element clip throat 181 which may be bordered by opposing first element clip lips 183 which may experience first element clip lip displacement 185 when the first element clip 11 is pushed from a first element clip unengaged position 201 onto the first frame element member 31 to the first element clip partially engaged position 203 and further first element clip lip reciprocation 187 as the first element clip 11 is pushed to the first element clip fully engaged position 205.

Similarly, referring to FIG. 8, for the preferred embodiment of the second element clip 13 shown, the second element clip 13 may be constructed of a material, such as steel or other strong, flexible metal or plastic, that provides for the second element clip spring bias 73 and second element clip reciprocation 74. The second element clip 13 may have a second element clip throat 191 which may be bordered by opposing second element clip lips 193 which may experience second element clip lip displacement 195 when the second element clip 13 is pushed from a second element clip unengaged position 211 onto the rear frame member 51 to the second element clip partially engaged position 213 and further second element clip lip reciprocation 197 as the second element clip 13 is pushed to the second element clip fully engaged position 215.

An optional feature of the present invention may be a quilting machine controller with pattern matching software which would allow the end points of the portion of the pattern sewn for a fabric zone 93 to be matched with the start points for the continued sewing of the pattern in the subsequent fabric zone 93 secured in place by the user using the quilting frame 5 of the present invention.

In view of the disclosures of this specification and the drawings, alternative embodiments of the first frame element 7, the second frame element 9, the first element clips 11 for securing the fabric zones 93 to the first frame element members 31, and the second element clips 13 for securing the fabric zones 93 to the rear frame member 51 other than that shown in the drawings of the present application, will be known to persons of skill in the art.

Figure 9:
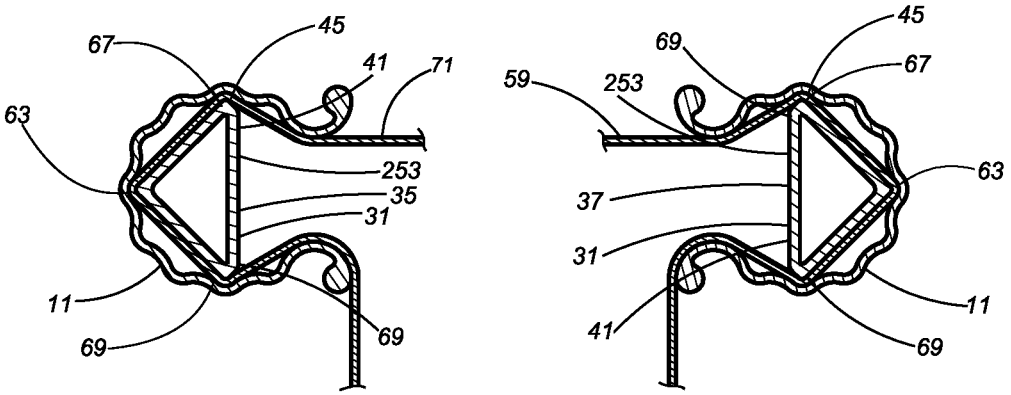
FIG. 9 is a cross-section detail of a preferred embodiment of the quilting frame of the present invention, the first frame members each having a triangular cross-section, showing a first element clip engaged with a first side frame member of the first frame element and a first element clip engaged with a second side frame member of the present invention, with a quilt core secured to the quilting frame by the first element clips.
Figure 10:
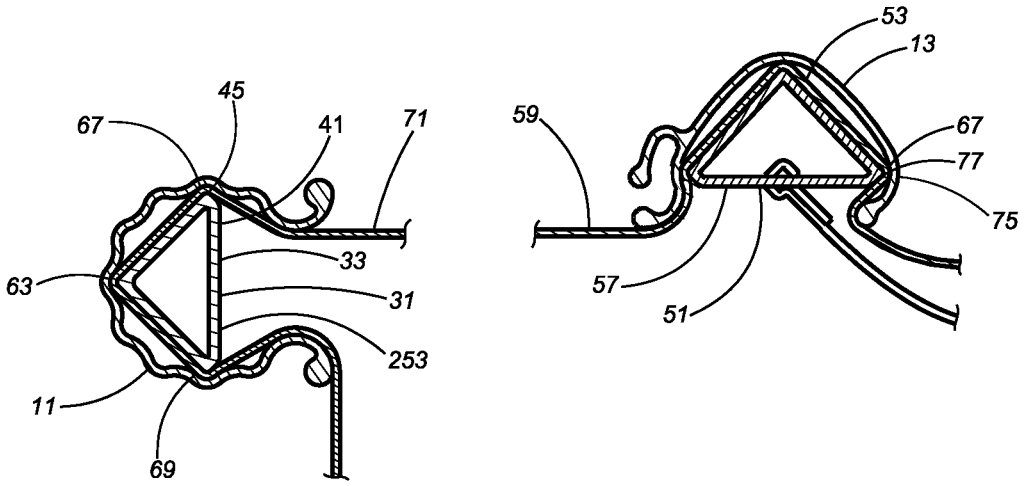
FIG. 10 is a cross-section detail of a preferred embodiment of the quilting frame of the present invention, showing a first element clip engaged with a front frame member of the first frame element and a second element clip engaged with a rear frame member of the second frame element of the present invention, the first frame member and the rear frame member having a triangular cross-section, with a quilt core secured to the quilting frame by the first element clip and the second element clip.
Figure 11:
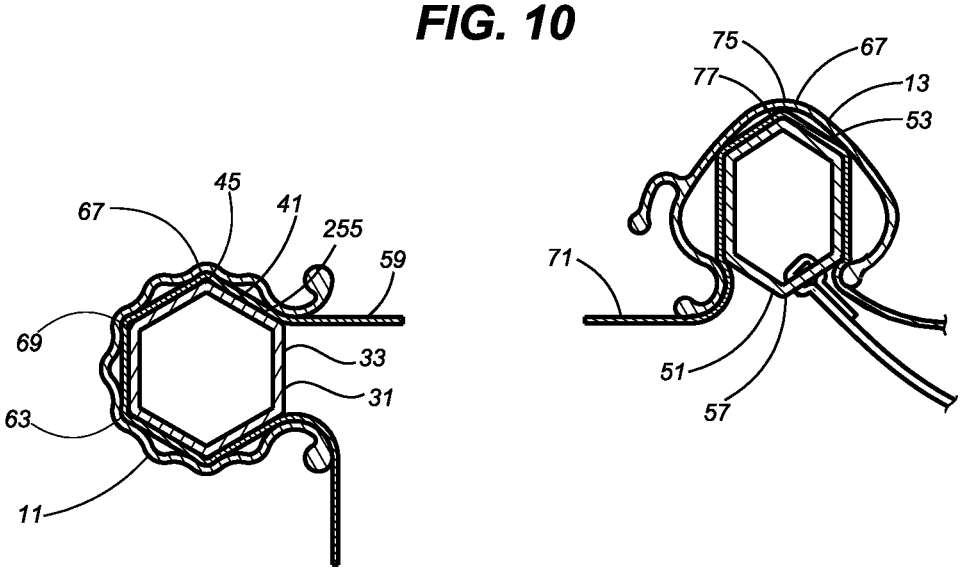
FIG. 11 is a cross-section detail of a preferred embodiment of the quilting frame of the present invention, showing a first element clip engaged with a front frame member of the first frame element and a second element clip engaged with a rear frame member of the second frame element of the present invention, the first frame member and the rear frame member having a hexagonal shaped cross-section, with a quilt core secured to the quilting frame by the first element clip and the second element clip.

Other embodiments of the first frame element members 31 may have a first frame member cross-section 41 which has a geometric shape with three or more first frame cross-sectional corners 69, which geometric shapes may include the triangular cross-section 253 illustrated in FIG. 9 or the hexagonal cross-section 255 illustrated in FIG. 11. Other geometric shapes for the first frame member cross-section 41 will be obvious to a person of ordinary skill in the art, in view of the disclosures of this specification and the drawings, which geometric shapes may include a diamond, a parallelogram, a pentagon, a heptagon, or an octagon. Where the term "geometric" is used in this specification, including the claims, in regard to the first frame member cross-section 41 it shall be defined to mean a cross-section having a geometric shape with three or more first frame cross-sectional corners 69. A rectangular, including particularly a square, first frame member cross-section 41, or a diamond or parallelogram first frame member cross-section 41, are preferred by the present inventor due to the ease of manufacturing and the ease and stability of the facet engagement 67 of the first clip inside frame receiver facets 63 with two or more first frame cross-sectional corners 69 of a first frame element member 31 with a quilt core 71 draped over the first frame element member 31 as shown in FIGS. 3, 5, 6, 9, 10 and 11. These embodiments of the first frame member cross-sections 41 readily provide for a preferred orientation of the first frame member cross-section 41 with a first frame member apex 45 oriented upwardly.

Similarly, other embodiments of the rear frame member 51 having a second frame member cross-section 53 which has a geometric shape with three or more rear frame member cross-sectional corners 77, which geometric shapes may include the triangular cross-section 253 illustrated in FIG. 9 or the hexagonal cross-section 255 illustrated in FIG. 11. Other geometric shapes for the second frame member cross-section 53 will be obvious to a person of ordinary skill in the art, in view of the disclosures of this specification and the drawings, which geometric shapes may include a diamond, a parallelogram, a pentagon, a heptagon, or an octagon. Where the term "geometric" is used in this specification, including the claims, in regard to the second frame member cross-section 53, it shall be defined to mean a cross-section having a geometric shape with three or more rear frame member cross-sectional corners 77. A rectangular, including particularly a square, second frame member cross-section 53, or a diamond or parallelogram second frame member cross-section 53, are preferred by the present inventor due to the ease of manufacturing and the ease and stability of the facet engagement 67 of the second clip inside frame receiver facets 75 with two or more second frame cross-sectional corners 77 of the rear frame member 51 of the second frame element 9 with a quilt core 71 draped over the rear frame member 51 of the second frame element 9 as shown in FIGS. 4, 5, 10 and 11. These embodiments of the second frame member cross-sections 53 readily provide for a preferred orientation of the second frame member cross-section 53 with a second frame member cross-sectional bottom corner 55 oriented downwardly.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A quilting frame assembly for quilting a quilt core, the quilting frame assembly comprising:

a frame support structure;

a quilting frame comprising first and second frame elements affixed to the frame support structure, the first frame element comprising three first frame element members, a front frame member, a first side frame member, and a second side frame member, each of the three first frame element members having a first frame geometric cross-section with a first frame cross-sectional top corner oriented upwardly as a first frame element member apex, and the second frame element comprising a rear frame member having a second frame geometric cross-section with a second frame cross-sectional bottom corner oriented downwardly as a second frame member base, the first frame member apex and the second frame member base being proximally positioned in and bordering a frame fabric plane;

a plurality of u-shaped, spring biased and reciprocating first element clips, wherein each of the plurality of first element clips has a plurality of first clip inside frame receiver facets dimensioned and positioned to engage with two or more or more first frame cross-sectional corners of a first frame element member with the quilt core draped over the first frame element member; and one or more u-shaped, spring biased and reciprocating second element clips, wherein each of the plurality of second clip inside frame receiver facets are dimensioned and positioned to engage with two or more or more second frame cross-sectional corners of the rear frame member with the quilt core draped over the rear frame member, the one or more second element clips being provided for the rear frame member.

2. The quilting frame assembly recited in claim 1 wherein each first frame element member has a first frame rectangular cross-section.

3. The quilting frame assembly recited in claim 1 wherein the rear frame member has a second frame rectangular cross-section.

4. The quilting frame assembly recited in claim 1 wherein each first frame element member has a first frame square cross-section.

5. The quilting frame assembly recited in claim 1 wherein the rear frame member has a second frame square cross-section.

6. The quilting frame assembly recited in claim 1 further comprising one or more second element roll straps affixed to the rear frame element by a second element roll strap anchor.

7. A quilting frame assembly for machine quilting of a quilt core using a quilting machine, the quilting frame assembly comprising:

a frame support structure;

a quilting frame comprising first and second frame elements each affixed to the frame support structure, the first frame element comprising three first frame element members, a front frame member, a first side frame member, and a second side frame member, each of the three first frame element members having a first frame geometric cross-section with a first frame cross-sectional top corner oriented upwardly as a first frame member apex, and the second frame element comprising a rear frame member having a second frame geometric cross-section with a second frame cross-sectional bottom corner oriented downwardly as a second frame member base, the first frame member apex and the second frame member base being proximally positioned in and bordering a frame fabric plane;

a machine carriage assembly mounted on the frame support structure, the machine carriage assembly providing for the lateral and longitudinal movement of the quilting machine;

a plurality of u-shaped, spring biased and reciprocating first element clips each having a plurality of first clip inside frame receiver facets dimensioned and positioned to engage with two or more or more first frame cross-sectional corners of a first frame element member with the quilt core draped over the first frame element member, one or more first frame element clips being provided for each first frame element member; and one or more u-shaped, spring biased and reciprocating second element clips each having a plurality of second clip inside frame receiver facets dimensioned and positioned to engage with two or more or more second frame cross-sectional corners of the rear frame member with the quilt core draped over the rear frame member, the one or more second element clips being provided for the rear frame member.

8. The quilting frame assembly recited in claim 7 wherein each first frame element member has a first frame rectangular cross-section.

9. The quilting frame assembly recited in claim 7 wherein the rear frame member has a second frame rectangular cross-section.

10. The quilting frame assembly recited in claim 7 wherein each first frame element member has a first frame square cross-section.

11. The quilting frame assembly recited in claim 7 wherein the rear frame member has a second frame square cross-section.

12. The quilting frame assembly recited in claim 7 further comprising one or more second element roll straps affixed to the rear frame element by a second element roll strap anchor.

13. The quilting frame assembly recited in claim 7 wherein the machine carriage assembly comprises a front carriage track, a rear carriage track, a lateral carriage element, and a pair of longitudinal tracks on the carriage lateral element.

14. A quilting frame assembly for quilting of a quilt core, the quilting frame assembly comprising:

a frame support structure;

a quilting frame comprising first and second frame elements each affixed to the frame support structure, the first frame element comprising three first frame element members, a front frame member, a first side frame member, and a second side frame member, each of the three first frame element members having a first frame rectangular cross-section with a first frame cross-sectional top corner oriented upwardly as a first frame member apex, and the second frame element comprising a rear frame member having a second frame rectangular cross-section with a second frame cross-sectional bottom corner oriented downwardly as a second frame member base, the first frame member apex and the second frame member base being proximally positioned in and bordering a frame fabric plane;

a plurality of first element clips, each of the plurality of first element clips is u-shaped, spring biased and reciprocating, and has a plurality of first clip inside frame receiver facets dimensioned and positioned to engage with two or more or more first frame cross-sectional corners of a first frame element member with the quilt core draped over the first frame element member, one or more first frame element clips being provided for each first frame element member; and one or more u-shaped, spring biased and reciprocating second element clips each has a plurality of second clip inside frame receiver facets dimensioned and positioned to engage with two or more or more second frame cross-sectional corners of the rear frame member with the quilt core draped over the rear frame member, the one or more second element clips being provided for the rear frame member.

15. The quilting frame assembly recited in claim 14 wherein each first frame element member has a first frame square cross-section.

16. The quilting frame assembly recited in claim 14 wherein the rear frame member has a second frame square cross-section.

17. The quilting frame assembly recited in claim 14 further comprising one or more second element roll straps affixed to the rear frame element by a second element roll strap anchor.

18. A quilting frame assembly for machine quilting of a quilt core using a quilting machine, the quilting frame assembly comprising:

a frame support structure;

a quilting frame comprising a first frame element and a second frame element, the first frame element and the second frame element being affixed to the frame support structure, the first frame element comprising three first frame element members, a front frame member, a first side frame member, and a second side frame member, each of the three first frame element members having a first frame rectangular cross-section with a first frame cross-sectional top corner oriented upwardly as a first frame member apex, and the second frame element comprising a rear frame member having a second frame rectangular cross-section with a second frame cross-sectional bottom corner oriented downwardly as a second frame member base, the first frame member apex and the second frame member base being proximally positioned in and bordering a frame fabric plane;

a machine carriage assembly mounted on the frame support structure, the machine carriage assembly providing for the lateral and longitudinal movement of the quilting machine;

a plurality of first element clips, each of the plurality of first element clips is u-shaped, is spring biased and reciprocating, and has a plurality of first clip inside frame receiver facets dimensioned and positioned to engage with three or more or more first frame cross-sectional corners of a first frame element member with the quilt core draped over the first frame element member, one or more first frame element clips being provided for each first frame element member; and one or more second element clips, each of the one or more second element clips is u-shaped, spring biased and reciprocating, and has a plurality of second clip inside frame receiver facets dimensioned and positioned to engage with three or more or more second frame cross-sectional corners of the rear frame member with the quilt core draped over the rear frame member, the one or more second element clips being provided for the rear frame member.

19. The quilting frame assembly recited in claim 18 wherein each first frame element member has a first frame square cross-section.

20. The quilting frame assembly recited in claim 18 wherein the rear frame member has a second frame square cross-section.

21. The quilting frame assembly recited in claim 18 further comprising one or more second element roll straps affixed to the rear frame element by a second element roll strap anchor.

22. The quilting frame assembly recited in claim 18 wherein the machine carriage assembly comprises a front carriage track, a rear carriage track, a lateral carriage element, and a pair of longitudinal tracks on the carriage lateral element.

* * * * *